United States Patent [19]

Elson et al.

[11] 4,438,815

[45] Mar. 27, 1984

[54] FOAM GRAVEL PACKING

[75] Inventors: Thomas D. Elson, Chino; Ralph S. Millhone, Brea, both of Calif.

[73] Assignee: Chevron Research Company, San Francisco, Calif.

[21] Appl. No.: 323,787

[22] Filed: Nov. 23, 1981

[51] Int. Cl.[3] ..... E21B 43/04

[52] U.S. Cl. ..... 166/278; 166/51

[58] Field of Search ..... 166/278, 276, 51, 308, 166/309, 280

[56] References Cited

U.S. PATENT DOCUMENTS

| | | | |
|---|---|---|---|
| 2,905,245 | 9/1959 | De Priester | 166/250 |
| 3,434,540 | 3/1969 | Stein | 166/278 X |
| 3,463,231 | 8/1969 | Hutchison et al. | 166/303 |
| 3,583,483 | 6/1971 | Foote | 166/250 |
| 3,603,398 | 9/1971 | Hutchison | 166/278 X |
| 3,980,136 | 9/1976 | Plummer et al. | 166/308 X |

*Primary Examiner*—Stephen J. Novosad

*Attorney, Agent, or Firm*—G. W. Wasson; L. S. Gruber; Edward J. Keeling

[57] ABSTRACT

A method of gravel packing a subsurface well is disclosed wherein particulate material is fluidized in a gas/liquid foam carrier fluid and transported to the subsurface where the particulate material forms the gravel pack and the foam carrier fluid returns to the surface.

6 Claims, 3 Drawing Figures

FOAM GRAVEL PACKING

BACKGROUND OF THE INVENTION

1. Field of the Invention

This invention relates to gravel packing of subsurface wells and has particular application to gravel packing in subsurface wells as used in the petroleum industry.

2. Description of the Prior Art

The production of fluid materials from an earth formation frequently carries with it portions of the formation causing potential problems with the producing equipment within the well bore and with the surface equipment associated with the well. Unconsolidated formations, particularly those containing loose sands and soft sandstone strata, present constant problems in well production due to migration of loose sands and degraded sandstone into the well bore as the formation deteriorates under the pressure of flow of fluids therethrough. This migration of particles may eventually clog the flow passages in the production system of the well and can seriously erode the equipment used in fluid production. The migration of particles is not necessarily dependent upon the viscosity or the flow rate of the produced fluids in that it is more likely to be dependent upon the degree of consolidation of the formation from which the fluids are produced and the procedures that have been used in preparing the formation for fluid production. In any event, the flow or migration of particles with the produced fluids may clog the production system and may lead to a complete cessation of flow or at least a reduction in production to a noneconomic rate.

It has long been known to control sand migration in a well bore by placing a pack of gravel on the exterior of a perforated or slotted liner or screen which is positioned within the well bore and through the unconsolidated interval of the formation being produced. A pack is placed in the annulus between the liner or screen and the open hole of the drilled formation. In prior art methods, the gravel is carried into the subsurface well in the form of a slurry, the carrier fluid being removed and returned to the surface. It has been known to place gravels of various size distributions to effectively halt sand migration through the gravel pack, the aperture in the liner or the screen being gauged so that the gravel material is packed within the well and will settle out in the annulus between the liner and the formation while the slurry carrying the fluid enters through the slots in the liner or screen and is returned to the surface.

In some cases, a gravel pack is placed between a liner or screen and an exterior casing which has been placed in the formation after the well has been drilled. The casing is perforated or slotted to permit production and the gravel material is placed in the annulus between the casing and the liner or screen without concern for damage to the formation.

Gravel packing is also used in uncased wells where the gravel is placed between a slotted liner or screen and the drilled formation. The packing of such wells can be complicated if the formation is susceptible to lost circulation or thief zones or if the formation may be damaged by conventional drilling or slurry fluids which may be used in the carrying of the gravel material to the subsurface location. In such wells, it is important to use a gravel carrier fluid which will not damage the formation and which will efficiently carry the gravel material from the earth's surface into the area to be packed.

It is also important in gravel packing a subsurface well that the gravel be placed in the annulus, whether between the liner and the formation or between the liner and the casing, at a density which provides an effective deterrent to the migration of formation particles while at the same time provides a desirable permeability for the flow of formation fluids into the well bore through gravel and into the screen or liner.

The prior art has recognized the need for tailoring both the gravel pack material and the carrier fluid to the particular characteristics of the formation being packed; however, so far as the present inventor is concerned, it has not been known to use a gas/liquid foam for the use of carrying gravel packing particulate material from the earth's surface into the subsurface formations for producing the desired well bore gravel pack. It is further believed that the methods and apparatus described in the present application have been heretofore unknown for placing of an effective gravel pack in a subsurface earth formation.

SUMMARY OF THE INVENTION

The present invention is directed to a method of moving particulate material from the earth's surface into a well utilizing a foam injected down the well with the particulate material being deposited within the well bore at a subsurface location and the foam circulated up the well to the surface. The method includes the steps of generating a gas/liquid foam which has a particular carrying capacity for particulate material and the mixing of that foam with the particulate material at the earth's surface to provide a high-quality foam for efficiently carrying particulate material to the subsurface formation. The invention further contemplates a surface apparatus for mixing particulate material with foam prior to injection into the well bore to provide for the maximization of the transport of particulate material to the subsurface location.

The present invention has application to the gravel packing of any subsurface well bore; however, it has particular application to shallow, under-pressured wells, where there is a potential for damage to the formation by conventional drilling fluids and/or to wells passing through a subsurface which includes a strata or formation having high permeability into which well bore fluids may flow freely, such formations frequently being called "thief zones." The drilling of wells through such formations has presented a serious problem to the well-drilling industry in that the formation itself may be seriously damaged by the drilling fluid used or the drilling fluid itself may be lost to the formation, thus preventing good drilling fluid circulation to the earth's surface. It has been known that gas/liquid foam drilling fluids are an effective means for circulation and drilling in such formations and that the formation itself is not subjected to well bore damage by the circulated foam material. The foam carrier fluid of the present invention is therefor effective in carrying particulate material into the well bore for positioning along the zone of interest and the fluid itself may be recovered at the earth's surface without loss to the formation and the pack can be completed in an efficient and economical manner.

The use of foam as the carrier fluid also reduces the possibility of segregation of the gravel material as it is transported to the zone to be packed. The foam carrier fluid supports the gravel in its mixed sizes and carries the mixed gravel to the subsurface location as a gravel mix.

The objects and features of the present invention will be readily apparent to those skilled in the art from the appended drawings and specification illustrating a preferred embodiment wherein.

DESCRIPTION OF THE PREFERRED EMBODIMENT

Figure 1:
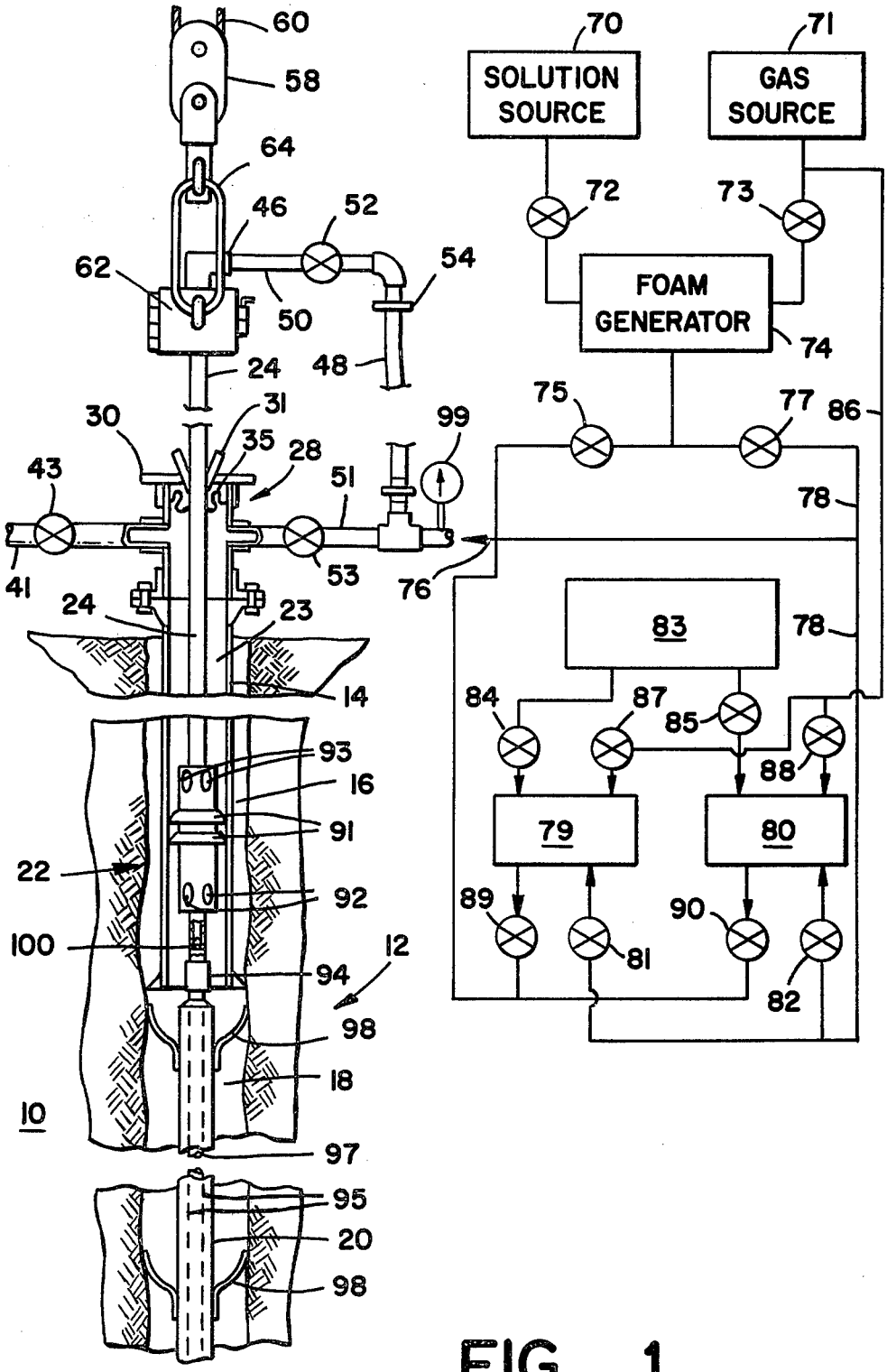
FIG. 1 is a partially schematic illustration of surface and subsurface apparatus as may be used to perform the method of the present invention.
Figure 3:
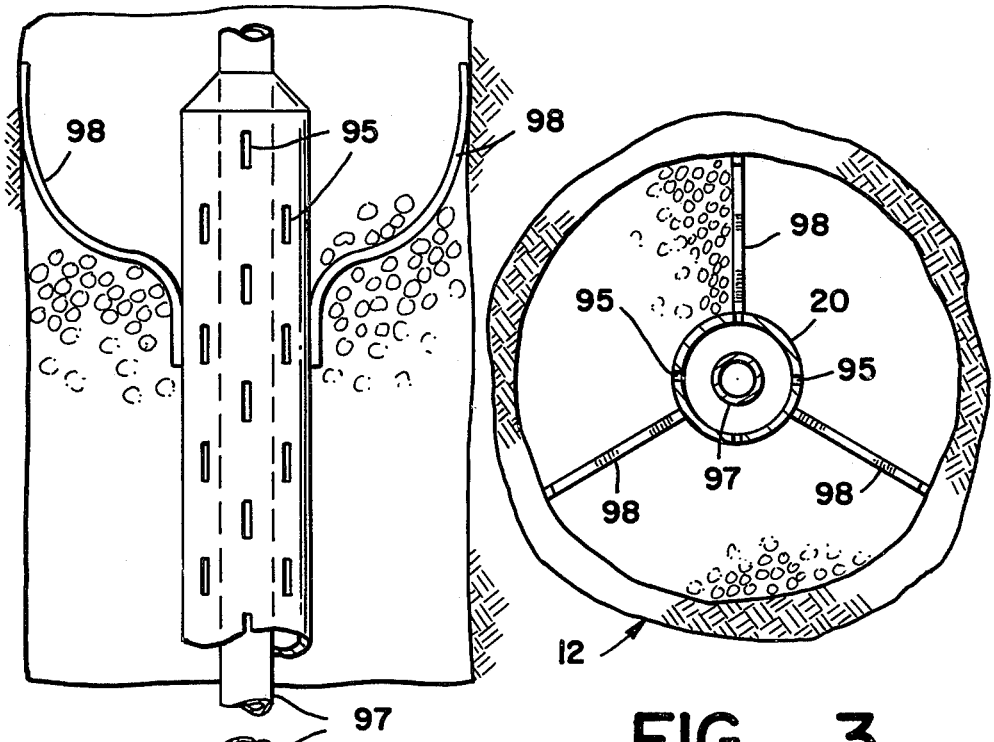
FIG. 3 is a sectional view through FIG. 2 taken along the lines 3—3.

Referring now to the drawings, FIG. 1 illustrates the preferred embodiment of apparatus assembled in accordance with the present invention. FIG. 1 is an elevational view, partially in section, of a well which penetrates an oil-bearing formation 10. This is the general environment where the method of the present invention finds utility. A producing interval 12 along the formation 10 has been drilled and prepared for production. A string of casing 14 extends from the upper portion of the producing interval 12 through the earth to the surface. The casing is suitably bonded by cementing material 16 to the earth formation between the producing zone and the earth's surface. A gravel pack 18 is positioned in the annulus between the face of the producing interval 12 and an interior slotted liner or screen 20 supported at the bottom of a gravel pack tool assembly 22 at the downhole end of a tubing or drill string 24.

In accordance with the preferred form of the invention, the tubing or drill string 24 is positioned in the well through a suitable wellhead 28. The size and type of the tubing string will depend upon the particular well being packed. Both segmented and continuous tubing strings are useful in the present invention. When using a segmented tubing string, slips 31 are positioned on a slip base plate 30 which is connected to the top of the wellhead 28. The slips 31 are used to hold the tubing string during makeup of the string. Stripper rubber 35 is used in the wellhead 28 to prevent leakage of the foam past the tubing string where it enters the wellhead. The lower end of the tubing or drill string 24 is connected to the gravel pack tool assembly 22 above the position along the oil-bearing formation 10 at the producing interval 12. The tubing string and the casing 14 form a well annulus 23. A blooie line 41 is connected through valve 43 to the well annulus 23 for exhausting foam from the annulus 23. Valve 43 also controls the back pressure placed in foam being circulated up the annulus with pressure being indicated by meter 99 in common foam conduit 76.

The tubing string may be raised or lowered in the well during foam circulation by hoist means which include a traveling block 58 moved by suitable cable 60. A conventional hoist means or derrick, not shown, is used to move the traveling block up and down. An elbow joint 46 is connected to the upper end of the tubing or drill string 24 and is held in an elevator 62 connected by suitable links 64 to move with the traveling block 58. Thus, when the traveling block 58 moves up or down, the tubing string and the apparatus connected thereto is also raised or lowered within the well bore.

Foam is formed by mixing together a foamable solution and a gas. Suitable surface apparatus for forming a foam include a foamable solution source 70 and a gas source 71. The gas and liquid sources are located at the earth's surface and are connected through valves 72 and 73 to a foam generator 74 where a gas/liquid foam is generated and passed through valve 75 to a common foam conduit 76 with pressure indicated by meter 99. A method and apparatus for generating foam is disclosed in U.S. Pat. No. 3,463,231 issued to S. O. Hutchison et al for Generation and Use of Foamed Well Circulation Fluids on Aug. 26, 1969 and assigned to the same assignee as the present application. The foam from foam generator 74 is also passed through a valve 77 to another conduit 78 for connection to mixing pots 79 and 80 through suitable valves 81 and 82, respectively.

Particulate material of a suitable grade and mix is supplied from particulate material source 83 through valving means 84 and 85 to the pots 79 and 80, respectively. The more common term for the particulate material is "gravel" and hereinafter the material added to the pots 79 and 80 will be referred to as "gravel."

Gas source 71 is also connected by conduit 86 to the pots 79 and 80 through suitable valves 87 and 88, respectively.

Pots 79 and 80 are connected through valves 89 and 90, respectively, to the common foam conduit 76.

The foam conduit 76 is connected to both the tubing or drill string 24 and the well annulus 23. The conduit is connected to the tubing string 24 through flexible conduit 48, hammer connection 54, conduit 50 and elbow joint 46. Valve 52 is used to control flow to the tubing string. The conduit 76 is connected to the well annulus 23 by means of conduit 51 via wellhead 28. Valve 53 controls flow to the well annulus. Thus, foam may be circulated in a normal manner, i.e., down the tubing and up the annulus or foam circulation may be reversed, i.e., down the annulus and up the tubing.

FIG. 1 also illustrates the downhole portion of the gravel packing apparatus. As herein illustrated, the tubing 24 supports the gravel pack tool assembly 22 within the casing 14. The gravel pack tool assembly 22 is a conventional item readily available in the petroleum industry and includes, among other things, one or more sets of downward-facing packer cups 91 supported on the gravel pack tool assembly between crossover exit ports 92 near the downhole end of the tool and foam return ports 93 in communication with the annulus 23. Below the crossover ports, the slotted liner or screen 20 is supported on the end of the gravel pack tool assembly 22 with a coupling 94 and a one-way valve 100 connecting the tool and the liner.

Figure 2:
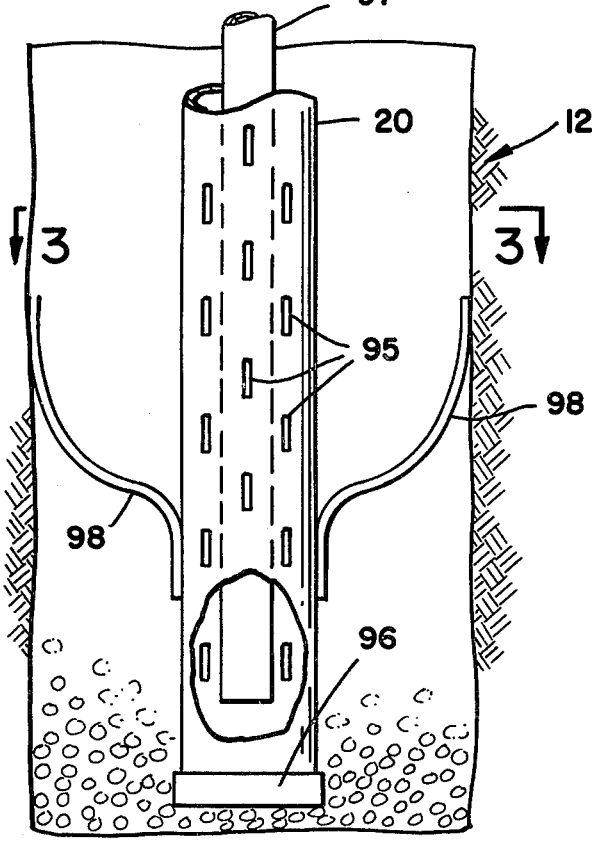
FIG. 2 is an enlarged sectional view of a subsurface formation packed in accordance with the present invention.

FIG. 2 is an enlarged view of the liner in place within a well. The liner is slotted at 95 along its entire length and has an endcap 96 at its lower end. A washpipe 97 is supported within the liner 20 with its lower end terminating above the inside end of endcap 96. The washpipe provides a flow path for fluid materials which flow in through the slots 95 in the liner 20 and up from the bottom of the inside of the liner to the gravel pack tool assembly where the washpipe 97 communicates with the foam return ports 93 through one-way valve 100.

A suitable number of centralizers 98 are fixed to the exterior of the liner 20 with the free end of the centralizers communicating with the interior of the open hole or perforated casing along the producing interval. The centralizers herein shown are designed to pass down through the casing and then spring outwardly toward the open hole; however, any form of centralizer which may be released when the liner is in the producing interval and which will place the liner substantially in the center of the open hole or cased well will be effective for the purpose herein intended. A minimum number of centralizers are used, with one at least at or near the top of the producing interval and another at or near the bottom of the producing interval. Additional centralizers would be used on the outside of the liner depending upon the length of the interval being packed.

The apparatus of the invention illustrated in FIG. 1 is particularly useful in the performance of the method of the present invention. It has been found that in well bores passing through oil-bearing formations which have a susceptibility to damage by excessive pressure from within the well bore or to damage by the drilling fluids, the use of foam drilling fluids can reduce the damage to the formation and reduce the amount of drilling fluid lost to the formation. Occasionally, oil-bearing formations contain highly permeable intervals will present an almost unfillable drain for the drilling fluids. Such intervals are frequently referred to as "thief zones." Foam drilling materials have been known to be used to avoid loss of the drilling fluids in that the foam itself is circulated at substantially lower pressure than conventional drilling fluids and at velocities which are not likely to cause damage to the formations. This same feature permits the foam drilling fluid to be used for the transport of particulate material down into the formation to accomplish successful gravel packing of the annulus between the face of the well bore and the producing conduit within the well bore. The foam circulated in an open interval of the well bore should have a liquid volume/gas volume ratio that produces a fluid density in the foam adequate to control reservoir pressure during the gravel packing operation.

The efficiency of accomplishing such a gravel packing is enhanced if the volume of particulate material carried with the foam material can be maximized so that the actual time taken to accomplish the gravel packing of the desired interval is substantially reduced. In accordance with that objective, the apparatus schematically illustrated in FIG. 1 is particularly effective in accomplishing the desired results.

In the FIG. 1 schematic portion, conventional foamable solution source 70 and gas source 71 are connected through valves 72 and 73 to a foam generator 74 where a foam of the desired consistency is formed. Reference should be had to U.S. Pat. No. 3,583,483, issued June 8, 1971 to Robert W. Foote for "Method For Using Foam In Wells," assigned to the same assignee as the present application, for a disclosure of the effectiveness of improved foams having high-lifting capability for use in wells by controlling the liquid volume/gas volume ratio of the foam to a desired value. The foam generated in foam generator 74 may be passed through valve 75 to common foam conduit 76 where the foam may be transported down the well bore either into the annulus through valve 53 or into the tubing through valve 52. Foam flowing through the tubing is the usual use of the foam for cleanout purposes and/or for drilling purposes.

If it is desired to place particulate material into the foam prior to transporting it down the well bore, it has been found by the present inventors that the most efficient manner of maximizing the content of the particulate material with the foam is to fluidize the particulate material with foam and then mix the fluidized foam-particulate mixture directly into the common foam conduit. It has further been found that placing the particulate material into a pot mixing container and passing foam material up through the particulate material in the container accomplishes the desired fluidizing of the particulate material without segregating the mixed material and that when thus fluidized, the foam particulate mixture may be forced out of the pot by passing gas into the pot to force the fluidized mixture directly into a conduit, herein the foam conduit 76, and into the well bore. Additional foam may be added to the foam particulate mixture through valve 75, if necessary.

The foregoing is accomplished by the apparatus illustrated in FIG. 1 by metering a desired quantity of particulate material from source 83 through valve 84 into pot 79 where the particulate material is mixed with foam supplied from the foam generator 74 through valve 77 and upwardly through valve 81 into the pot 79. When the mixture is properly fluidized, valves 84 and 81 are closed and valve 87 which is connected to a supply from gas source 71 is opened to force the fluidized foam-particulate mixture out of the pot through valve 89 into the common foam conduit 76 and thus into the well bore. A pair of pots is illustrated to permit the continuous formation of the desired foam-particulate mixture in that while the process just described is being accomplished through the use of pot 79, pot 80 may be charged with particulate material through valve 85 and foam may be passed upwardly through valve 82 to fluidize the mixture. After pot 79 has been cleared through valve 89, and after valves 87 and 89 have been closed, valve 90 may be opened and gas source 71 may be connected to pot 80 through valve 88 to cause the fluidized foam-particulate mixtures to be passed out through the valve 90 and into the common foam conduit 76. By alternating the charging and discharging of the two pots 79 and 80, the desired fluidized foam-particulate mixture may be supplied continuously to the downhole apparatus to accomplish the desired gravel packing efficiently.

It should be evident, with reference to the downhole portion of FIG. 1, that, with valve 53 closed and valve 52 open, the foam-particulate mixture is transported down the tubing 24 to pass outwardly through crossover exit ports 92 at the gravel pack tool assembly 22 and into the annulus outside the liner 20. The foam-particulate mixture moves to the bottom of the desired interval and gradually deposits the unsegragated particulate material within the annulus exterior of the slotted liner 20. The foam fluidizing material passes in through the slots and downwardly through the annulus between the washpipe 97 and the inside of the liner 20 to enter the washpipe at its lower end and pass upwardly through the washpipe and one-way valve 100 into the gravel pack tool assembly, there to exit the tool through the foam return ports 93. The foam continues upwardly through the annulus and exits from the annulus through valve 43 and the blooie line 41. The control on valve 43 permits the back pressure on the foam to be controlled and observed at meter 99 so as to accomplish the desired placement of the particulate material without damage to the face of the formation and without transporting the particulate material backwardly into the formation possibly causing fracturing the formation. The centralizers 98 along the exterior of the slotted liner 20 are minimized to permit the foam-particulate mixture to pass around and completely within the annulus at the producing interval to there deposit the particulate material to form the gravel pack 18 without causing voids along the pack because of interference with the centralizers.

It has been found that the best foam mixture to use for transporting gravel material to the portion of the formation to be packed is a high-quality foam containing a minimum amount of fluid and a maximum amount of gas while at the same time containing a maximum amount of the particulate material. One such foam mixture is a foam which has a ratio of the liquid volume to the gas volume of between 0.02 to 0.25.

If the foam looses its ability to support the gravel material, additional fluid may be added to the fluid/gas ratio to increase the carrying capability of the foam.

It has been further found that the best gravel packing material for a particular formation is provided if an analysis is made of the particle sizes within the formation and the particulate material is graded according to those materials within the formation. Reference should be had to publication by R. J. Saucier in Journal of Petroleum Technology, February, 1974, page 205, titled "Considerations in Gravel Pack Design" and U.S. Pat. No. 2,905,245, issued Sept. 22, 1959 to C. L. DePriester for "Liner Packing Method" which describe methods for choosing a graded packing material based on formation material. Other methods for selecting the preferred gravel mix are known and are equally useful in the method of the present invention.

In accomplishing a successful gravel pack, it is desirable to carry the gravel material to the formation in as efficient a manner as possible.

A successful gravel pack in the subsurface producing interval is a placement of a permeable gravel pack having as low a porosity as possible. The lowest porosity that can be obtained with graded sand typically used in gravel packing is about 36%.

A fluidized foam gravel mixture will result in a higher porosity in a unit volume of the mixture. Therefore, the concentration of gravel in a unit volume of foam gravel mixture at 36% porosity will represent the upper limit for fluidization and the subsequent limit on gravel that may be carried by the foam.

Based upon the above, it is possible to determine the maximum weight of gravel that can be carried by foam at the expected porosity. For a unit volume of one gallon, the weight of gravel (here a typical graded sand) is calculated from its density, $\rho$:

$$Wt_{(gravel)}=(1-\phi)\rho_{(gravel)}$$

for gravel, $\rho \cong 22.2$ pounds per gallon.

The calculated weight of gravel in the unit volume of one gallon is about 14.21 pounds. The volume of foam at the given porosity of 36% is 0.36 gallons.

Thus, concentration (Weight/gallon) = 14.21/0.36 or 39.5 pounds/gallon.

It is, however, practical to have successful gravel packs by placing gravel with porosity much greater than 36% and such gravel packs can be accomplished with fluidized foam gravel mixtures carrying less gravel per unit of foam. For example, for a fluidized state giving a porosity of 50% or greater, a calculation as in the previous paragraphs will show that a gravel concentration in the foam gravel mixture of between about zero and about 22 pounds per gallon will produce an effective gravel pack.

Gravel packing with foam can be done with up to 39.5 pounds of gravel per gallon of foam and can be done successfully in the range of between zero and 22 pounds per gallon.

A successful placement of a foam gravel pack within the formation can be identified by a build-up of injection pressure as indicated by meter 99 and a severe decrease in the foam transported through the annulus and out through the blooie line 41. These two indications, coupled with knowledge that the pack is actually placed in the annulus and not blocked by a restriction along the placement path, illustrate that the annulus around the liner 20 is full of gravel material and the pack is beginning to fill up along and above the liner so that no further foam or gravel material is being circulated down through the annulus at the producing interval. The reduction in the amount of foam exiting through the blooie line is a further indication that circulation has begun to decrease through the well bore.

A procedure to be followed in placing a gravel pack with the fluidized foam material may be as follows: Displace the fluid which had been used in drilling the well (in the event that other than foam has been used in drilling the well) with a foam generated by foam generator 74 and passed into the system through foam conduit 76, either through the annulus 23 or through the tubing 24 as appropriate. If the producing interval is in a cased well, the casing is perforated and the liner placed along the perforated interval. If the producing interval is in an open well and the well has not already been open to a larger diameter, it may be desirable to enlarge the producing hole size and preferably the enlargement is done with a foam drilling fluid. Once the hole has been placed into an operating size, a caliper is run to determine the actual size of the hole to be packed. Determination of hole size is needed to properly calculate the amount of gravel to be placed within the producing interval. After hole size has been determined, the liner is placed in the producing interval.

Then the particulate material is mixed with the foam, as previously described, to produce the fluidized foam-particulate mixture to be run into the well through the tubing string. The foam-particulate mixture passes outwardly through the gravel pack tool assembly and into the annulus around the liner to there place the gravel in position along the annulus. The foam carrier fluid passes through the slots in the liner and into the washpipe for returning to the surface.

Once pack-off has been completed, it is then desirable to reverse circulate the fluid with foam alone to remove any excess gravel in the tubing or drill string 24. To accomplish this, foam is circulated through the tubing casing annulus 23 down past the two flexible rubber cups 91 and up the tubing or drill string via crossover port 92. Fluid will not go down tailpipe 97 because of check valve 100. Subsequently, the gravel packing tool 22 is retrieved and an appropriate seal adapter can be run and attached to the top of the liner and then the well is ready for production.

It has been found that gravel packed in accordance with the foregoing description has been able to accomplish a theoretical fill as high as from 87% to 128% of the calculated producing interval void at the outside of the slotted liners in actual oil wells. In most cases, a gravel pack of more than 85% of the theoretical fill calculation is considered to be a successful gravel pack. It has been found that gravel packing with foam as the carrier fluid accomplished a satisfactory gravel fill while providing the desired pack permeability with a satisfactory pack porosity. It has also been found that during gravel packing with foam no fluid losses to the formation are experienced. Conventional gravel placement fluids (i.e. water, mud, polymer) have been known to have large fluid loss to the formation and can cause formation damage in shallow, under-pressure formations.

While a certain preferred embodiment of the invention has been specifically disclosed, it should be understood that the invention is not limited thereto, as many variations will be readily apparent to those skilled in the art and the invention is to be given its broadest possible interpretation within the terms of the following claims.

We claim:

1. A method for packing particulate material in a well bore subsurface location comprising the steps of:

(a) generating a stable foam material at the surface above said well;

(b) injecting said foam through said particulate material from below to produce a foam-particulate mixture and to fluidize said mixture of foam and particulate material;

(c) forcing said fluidized foam-particulate mixture into said well bore and to said subsurface location;

(d) causing said particulate material of said foam-particulate mixture to be retained at said subsurface location; and (e) moving said foam of said foam-particulate mixture upward through said well bore.

2. The method of claim 1 wherein said mixing is accomplished in a mixing pot.

3. The method of claim 2 wherein said fluidized foam-particulate mixture is moved out of said pot by a gas injected into said pot from above to move said fluidized foam-particulate mixture into said well bore.

4. The method of claim 1 wherein said mixing is accomplished in at least a pair of mixing pots with at least one of said pots containing a fluidized foam-particulate mixture connected to said well bore while another of said pots is charged with said particulate material and foam to produce said fluidized foam-particulate mixture, said pots being connected to said well bore as each contains a fluidized foam-particulate mixture, said pots when emptied being disconnected from said well bore and at least another of said pots containing said fluidized foam-particulate mixture being connected to said well bore in sequence, said disconnected pot then being charged with said particulate material and foam to produce said fluidized foam-particulate mixture.

5. The method of claim 4 wherein said fluidized foam-particulate mixture is fluidized in said pots by injecting foam into said particulate charge from the bottom of said pots and into said particulate charge.

6. The method of claim 4 wherein said fluidized foam-particulate mixture is discharged out of said pots to said well bore by a gas injected into said pots from above said fluidized foam-particulate mixture.

* * * * *